US007325330B2

(12) United States Patent
Kim et al.

(10) Patent No.: US 7,325,330 B2
(45) Date of Patent: Feb. 5, 2008

(54) APPARATUS AND METHOD FOR ELIMINATING WRINKLES IN CLOTHES

(75) Inventors: Hyun Suk Kim, Suwon-Si (KR); Hyung Gyoon Kim, Suwon-Si (KR); Seon Woo Park, Suwon-Si (KR); Seong Min Oak, Masan (KR); Jee Hun Park, Suwon-Si (KR); Yoon Sook Lee, Gimpo-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 2 days.

(21) Appl. No.: 11/178,284

(22) Filed: Jul. 12, 2005

(65) Prior Publication Data

US 2006/0117596 A1 Jun. 8, 2006

(30) Foreign Application Priority Data

Dec. 2, 2004 (KR) ..... 10-2004-0100610

(51) Int. Cl.
*F26B 5/04* (2006.01)

(52) U.S. Cl. ..... 34/407; 34/595; 34/606; 68/24; 134/22.1; 8/158

(58) Field of Classification Search ..... 34/380, 34/381, 407, 595, 601, 606; 68/24; 134/22.1; 8/158, 149

See application file for complete search history.

(56) References Cited

U.S. PATENT DOCUMENTS

| | | | | |
|---|---|---|---|---|
| 3,727,811 | A * | 4/1973 | Buckley | 223/70 |
| 4,207,683 | A * | 6/1980 | Horton | 34/60 |
| 5,730,006 | A * | 3/1998 | Conley | 68/6 |
| 2001/0020338 | A1 | 9/2001 | Arrieta et al. | |
| 2005/0034248 | A1 | 2/2005 | Oh et al. | |

FOREIGN PATENT DOCUMENTS

| | | | |
|---|---|---|---|
| EP | 1 275 767 | A | 1/2003 |
| EP | 1 275 767 | A1 | 1/2003 |
| JP | 6-233898 | A | 8/1994 |
| JP | 6233898 | | 8/1994 |
| JP | 8-103596 | A | 4/1996 |
| JP | 2001-70697 | A | 3/2001 |
| JP | 2003-326077 | A | 11/2003 |
| JP | 2004-57235 | A | 2/2004 |
| JP | 2004057235 | A | 6/2004 |
| KR | 1989-0018007 | A | 12/1989 |
| KR | 91-000838 | B1 | 2/1991 |
| KR | 1995-0018856 | A | 7/1995 |
| KR | 1998-012498 | U | 6/1998 |
| KR | 0128148 | Y1 | 7/1998 |
| KR | 20-0179327 | Y1 | 4/2000 |
| WO | WO 2006/009364 | A1 | 1/2006 |

* cited by examiner

*Primary Examiner*—S. Gravini
(74) *Attorney, Agent, or Firm*—Sughrue Mion, Pllc.

(57) ABSTRACT

Apparatus and method for eliminating wrinkles in clothes in a washing or drying machine using steam to eliminate the wrinkles in clothes, in a state in which the clothes are worn by a user or stored, as well as in a state in which washing of the clothes is terminated. The method includes determining whether or not a wrinkle-eliminating course is selected; supplying hot air to the clothes to eliminate dust from the clothes when it is determined that the wrinkle-eliminating course is selected; and supplying steam to the clothes, from which the dust was eliminated, to eliminate the wrinkles in the clothes.

19 Claims, 5 Drawing Sheets

APPARATUS AND METHOD FOR ELIMINATING WRINKLES IN CLOTHES

CROSS-REFERENCE TO RELATED APPLICATION

This application claims the benefit of Korean Patent Application No. 2004-100610, filed Dec. 2, 2004, in the Korean Intellectual Property Office, the disclosure of which is incorporated herein by reference.

BACKGROUND OF THE INVENTION

1. Field of the Invention

The present invention relates to an apparatus and a method for eliminating wrinkles in clothes in a washing or a drying machine having a steam generating device, and more particularly, to an apparatus and a method for eliminating wrinkles in clothes by generating steam to the inside of a washing or a drying machine.

2. Description of the Related Art

Generally, a drying machine is an apparatus for drying wet clothes by rotating a drum containing the clothes (laundry) at a low speed and supplying hot air, obtained by heating and using a heater, to the inside of the drum. Recently, a washing machine having a drying device for performing a drying function (generally, a drum washing machine) is being sold on the market.

Korean Patent Registration No. 10-0435241 discloses a washing machine having a drying device.

When the washing machine, disclosed by the above Patent, performs a drying operation after a dehydrating operation, a drying fan (a blower) generates and sprays compressed air under the condition that a heater is driven to heat an inner space of a chamber.

The sprayed compressed air passes thorough the inner space of the chamber and is converted into hot air, and the hot air is supplied to clothes in a drum to dry the clothes.

The above conventional washing machine removes moisture from the clothes using air of a high temperature heated by the heater under the condition that the dehydrated clothes are placed in the drum, thereby causing the clothes, which have become tangled in the dehydrating operation, to be dried, thus generating wrinkles in the clothes.

In order to solve the above problem, Korean Utility Model Registration No. 0128148 discloses a method for minimizing wrinkles in clothes by supplying steam having a designated moisture content to the dried clothes.

A washing machine, disclosed by the above Utility Model, supplies steam to the clothes, which were dried while in a tangled state, so that the clothes have a designated moisture content. Accordingly, when the clothes are shaken and spread, and are hung out for a designated time, the moisture of the clothes naturally evaporates and the clothes are smoothed out so that the wrinkles in the clothes are minimized. Further, when the clothes are ironed to eliminate the wrinkles, additional moisture is not required, thereby shortening the ironing time. However, since the wrinkles still remain in the clothes, the above method is disadvantageous in that a user must iron the clothes and a drying time taken to naturally evaporate the moisture of the clothes is long.

A drying machine exclusively having a drying function has the above problems, also.

Further, in the case that the steam is supplied to the clothes in a low-temperature state in winter, when the steam at a high temperature is sprayed, a door made of glass may become frozen and crack. When the steam is sprayed to the insides of a duct and a drum at a low temperature, the steam is converted into water and the water falls in the inside of the duct and the drum, or if the steam is sprayed, the steam is condensed on the surface of the glass door at a low temperature and water passes along the surface of the glass door. That is, it is difficult to efficiently spray steam.

Further, in order to reduce the wrinkles in clothes, a method for forming an algorithm for setting courses and functions for forcibly terminating a drying operation when the drying operation at a temperature for a time predetermined according to materials of the clothes is in progress so that ironing is easily performed is suggested. However, the above method eliminates the wrinkles in the clothes only by washing or ironing, but does not have a function for eliminating the wrinkle in the clothes generated when the clothes are put on by a user or stored.

SUMMARY OF THE INVENTION

Therefore, one aspect of the invention is to provide an apparatus and method for eliminating wrinkles in clothes, in which wrinkles in clothes, in a state in which the clothes are worn by a user or stored as well as in a state in which washing of the clothes is terminated by a separate wrinkle-eliminating course using steam, are eliminated.

A further aspect of the invention is to provide an apparatus and method for eliminating wrinkles in clothes, in which steam at a high temperature is sprayed directly to less contaminated clothes necessary to be smoothed down rather than to be washed, thereby effectively eliminating the wrinkles in the clothes without washing, and sterilizing the clothes.

Another aspect of the invention is to provide an apparatus and method for eliminating wrinkles in clothes, in which hot air is supplied to clothes, to which steam was sprayed, thereby efficiently eliminating the wrinkles in the clothes without ironing, and not requiring any additional drying operation.

Yet another aspect of the invention is to provide an apparatus and method for eliminating wrinkles in clothes, in which hot air is supplied to the clothes prior to steam being sprayed to the clothes, thereby eliminating dust or contaminants from the clothes, preventing a door from being frozen and cracking in winter due to the sprayed steam, and inducing the steam to be smoothly sprayed.

In accordance with one aspect, the present invention provides a method for eliminating wrinkles in clothes comprising: determining whether or not a wrinkle-eliminating course is selected; and supplying steam to the clothes and supplying hot air to the clothes, to which the steam was supplied, to eliminate the wrinkles in the clothes, when it is determined that the wrinkle-eliminating course is selected.

Preferably, but not necessarily, the wrinkle-eliminating course may be an independent course for only eliminating the wrinkles in the clothes.

Further, preferably, but not necessarily, a dried state of the clothes may be sensed when the hot air is supplied to the clothes, and the supply of the hot air may be stopped when the drying of the clothes is completed.

Moreover, preferably, but not necessarily, the steam may be supplied to the clothes for a predetermined time; and the hot air may be supplied for another predetermined time, or according to the dried state of the clothes.

Preferably, but not necessarily, hot air obtained by preheating may be supplied to the clothes before the steam is supplied to the clothes so as to eliminate dust from the clothes.

In accordance with another aspect, the present invention provides a method for eliminating wrinkles in clothes comprising: determining whether or not a wrinkle-eliminating course is selected; supplying hot air to the clothes to eliminate dust from the clothes when it is determined that the wrinkle-eliminating course is selected; and supplying steam to the clothes, from which the dust was eliminated, to eliminate the wrinkles in the clothes.

In accordance with another aspect, the present invention provides an apparatus for eliminating wrinkles in clothes, contained in a drum, comprising: a signal input unit for selecting a wrinkle-eliminating course; a steam generating device for supplying steam to the inside of the drum; a drying device for supplying hot air to the inside of the drum, to which the steam was supplied; and a control unit for controlling the steam generating device to eliminate the wrinkles in the clothes when the wrinkle-eliminating course is selected.

Preferably, but not necessarily, the wrinkle-eliminating course may be an independent course for only eliminating the wrinkles in the clothes or an operational course for eliminating the wrinkles in the clothes after an operation is completed.

Further, preferably, but not necessarily, the drum may be rotated at a predetermined rpm and a predetermined operation ratio when the steam and the hot air are supplied to the inside of the drum.

Moreover, preferably, but not necessarily, the control unit may operate the steam generating device for a predetermined time to control the steam generating device.

Preferably, but not necessarily, the control unit may sense a dried state of the clothes when the hot air is supplied to the inside of the drum, and cut off the supply of the hot air by stopping the operation of the drying device when the drying of the clothes is completed.

Further, preferably, but not necessarily, the control unit may control the supply of the hot air by operating the drying device at a predetermined temperature for a predetermined time or according to the dried state of the clothes.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EXEMPLARY EMBODIMENTS

Figure 1:
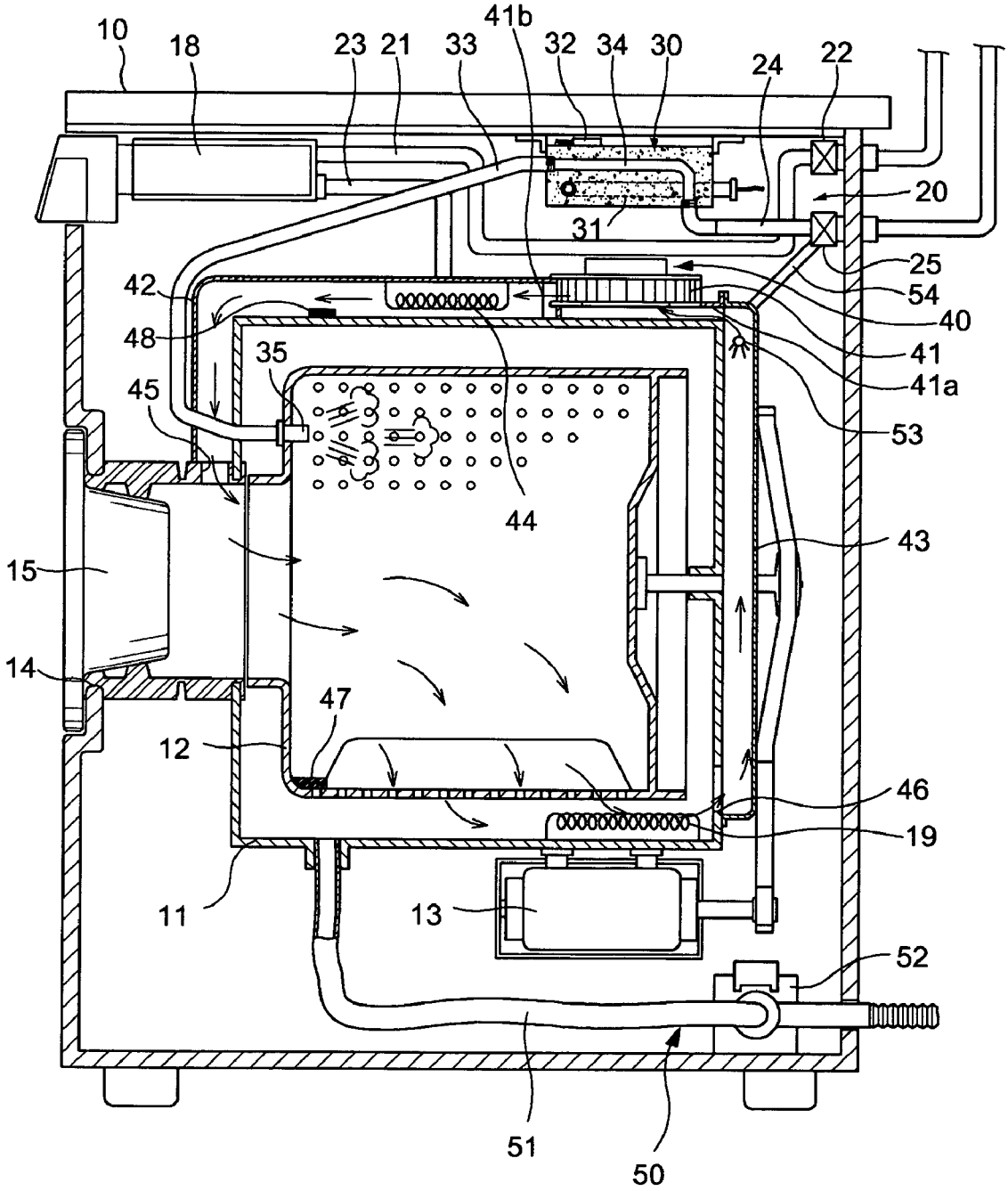
FIG. 1 is a sectional view of a washing machine having a steam generating device in accordance with a first embodiment of the present invention.

Reference will now be made in detail to the embodiments of the present invention, an example of which is illustrated in the accompanying drawings, wherein like reference numerals refer to like elements throughout. The embodiments are described below to explain the present invention by referring to the annexed drawings.

FIG. 1 is a sectional view of a washing machine having a steam generating device in accordance with a first embodiment of the present invention.

In FIG. 1, the washing machine having the steam generating device in accordance with the first embodiment of the present invention comprises a drum-shaped tub 11 installed in a main body 10 for containing washing water, and a rotary drum 12 rotatably installed in the tub 11 and provided with a plurality of dehydration holes.

A motor 13 for rotating the rotary drum 12 in a designated regular direction or its reverse direction to performing washing, rinsing, and dehydrating operations is installed under the tub 11, and a washing heater 19 for heating the washing water, supplied to the inside of the tub 11 when a user select a temperature of the washing water, is installed on the bottom of the inside of the tub 11.

An opening 14 for allowing the user to take clothes out of the main body 10 is formed through the front surfaces of the tub 11 and the rotary drum 12, and a door 15 for opening and closing the opening 14 is installed on the front surface of the main body 10.

A detergent supply device 18 for supplying detergent to the inside of the tub 11, a steam generating device 30 for supplying steam to the inside of the tub 11, and a water supply device 20 for supplying water to the tub 11 and the steam generating device 30 are installed above the tub 11.

The inside of the detergent supply device 18 is divided into plural spaces, and the detergent supply device 18 is installed in the front portion of the main body 10 so that the user easily supplies the detergent and a fabric softener to the respective spaces.

The water supply device 20 includes a water supply pipe 21 for supplying the water to the tub 11, and a water supply valve 22 installed in the water supply pipe 21 for controlling the supply of the water into the water supply pipe 21. Here, the water supply pipe 21 is connected to the detergent supply device 18 so that the water is supplied from the outside to the detergent supply device 18. A separate connection pipe 23 for supplying the water from the detergent supply device 18 to the tub 11 is installed between the detergent supply device 18 and the tub 11. The water, supplied to the inside of the tub 11, passes through the detergent supply device 18, thereby allowing the detergent in the detergent supply device 18 to dissolve in the water and then to be supplied to the tub 11.

The water supply device 20 further includes a steam water supply pipe 24 for supplying the water to the steam generating device 30, and a steam valve 25 installed in the steam water supply pipe 24 for controlling the supply of the water into the steam generating device 30.

Although the water supply valve 22 and the steam valve 25 are separately formed in this embodiment, the present invention is not limited thereto. That is, the water supply valve 22 and the steam valve 25 may be integrated into a conventional motor-driven three-way or four-way valve.

The steam generating device 30 includes a U-shaped steam heater 31 installed therein for temporarily heating water passing therethrough to generate steam at a high temperature of more than 100° C., a temperature sensor 32 installed on the outer surface of the steam generating device 30 for sensing the temperature of the steam generating device 30, a steam supply pipe 33 extended from the steam generating device 30 towards a drying duct 42 for supplying the generated steam to the drying duct 42, a steam generating pipe 34 provided with an inlet connected to the steam water supply pipe 24 and an outlet connected to the steam supply pipe 33, and a spray nozzle 35 installed at the outlet of the steam supply pipe 33.

Although the steam heater 31 is installed inside the steam generating device 30 in this embodiment, the present invention is not limited thereto. That is, the steam heater 31 may be an external heater contacting the outer surface of the upper or lower portions of the steam generating device 30, or may surround the outer surface of the steam generating device 30.

The washing machine in accordance with the first embodiment of the present invention further comprises a drying device 40 for drying clothes (laundry). The drying device 40 includes a drying fan 41 installed on the tub 11, the drying duct 42 connecting an outlet 41*b* of the drying fan 41 and an air inlet 45 formed through the upper portion of the opening 14 of the tub 11, and a condensing duct 43 installed in the rear of the tub 11 for connecting an air outlet 46 formed through the lower part of the rear surface of the tub 11 and an inlet 41*a* of the drying fan 41.

The drying device 40 further includes a drying heater 44 installed in the drying duct 42 for supplying hot air to the inside of the tub 11, a drying sensor 47 installed in the rotary drum 12 for sensing a dried state of the clothes, a duct temperature sensor 48 installed in the drying duct 42 for sensing the temperature in the drying duct 42 when hot air is supplied to the tub 11, and a condensing device installed in the condensing duct 43 for condensing moisture to eliminate it when steam having a high humidity generated from the drying of the clothes passes through the condensing duct 43.

The above constitution of the drying device 40 causes air, blown by the operation of the drying fan 41, to be heated by the drying heater 44 and then to be supplied to the inside of the tub 11, thereby heating and drying the clothes in the tub 11. Further, when the steam having a high humidity generated from the drying of the clothes is inhaled into the drying fan 41 through the condensing duct 43, moisture in the air is eliminated.

The condensing device includes a cooling water spray nozzle 53 installed at the upper portion of the inside of the condensing duct 43 for spraying cooling water to the inside of the condensing duct 43, and a cooling water supply pipe 54 connected to the water supply device 20 for supplying the cooling water to the cooling water spray nozzle 53. The above constitution of the condensing device causes the cooling water sprayed from the cooling water spray nozzle 53 to flow down along the inner surface of the condensing duct 43, thereby increasing contact between air having a high humidity ascending and the cooling water, thus improving a dehumidifying effect.

The washing machine in accordance with the first embodiment of the present invention further comprises a drainage device 50 for discharging water in the tub 11. The drainage device 50 includes a drainage pipe 51 connected to the lower portion of the tub 11 for guiding the water of the tub 11 to the outside, and a drainage pump 52 installed in the drainage pipe 51.

Hereinafter, the operation of the above washing machine having the steam generating device will be described.

When the washing machine is operated under the condition that clothes are put into the rotary drum 12 and a detergent is supplied to the detergent supply device 18, the water supply valve 22 of the water supply device 20 is opened so that water is supplied to the detergent supply device 18. The detergent in the detergent supply device 18 dissolves in the washing water, which is supplied to the tub 11 through the detergent supply device 18, and is then supplied to the tub 11.

After the supply of the washing water is completed, the washing heater 19 is operated to heat the washing water filling the tub 11. After a designated time elapses so that the washing water is heated to a temperature necessary for washing, the rotary drum 12 is rotated in a designated regular direction or its reverse direction by the operation of the motor 13.

Here, lifters installed on the inner surface of the rotary drum 12 move the clothes so that the clothes are washed by friction between the clothes and the rotary drum 12 and the decomposition effect of the detergent.

After the washing is completed, a rinsing operation, in which a dehydration of the clothes and a supply of water to the clothes are repeated, is performed. Water for performing the rinsing operation is supplied to the inside of the tub 11 through the water supply pipe 21 by opening the water supply valve 22, and the water in the tub 11 is discharged to the outside through the drainage pipe 51 by the operation of the drainage pump 52.

When a final dehydrating operation is performed after the rinsing operation, the drainage pump 52 is operated and the rotary drum 12 is rotated at a high speed for a designated time, thereby dehydrating the clothes.

When a drying operation is performed after the dehydration of the clothes is completed as described above, the rotary drum 12 is slowly rotated by the operation of the motor 13 so that the clothes in the rotary drum 12 are dropped. When the drying fan 41 is operated in this state, air in the tub 11 is sucked into the drying fan 41 through the condensing duct 43, and is discharged to the inside of the tub 11 through the drying duct 42. This circulation of the air is repeated.

Here, air in the drying duct 42 is heated by the drying heater 44, and is supplied to the inside of the rotary drum 12, and the clothes in the rotary drum 12 are heated and dried by hot air.

Figure 2:
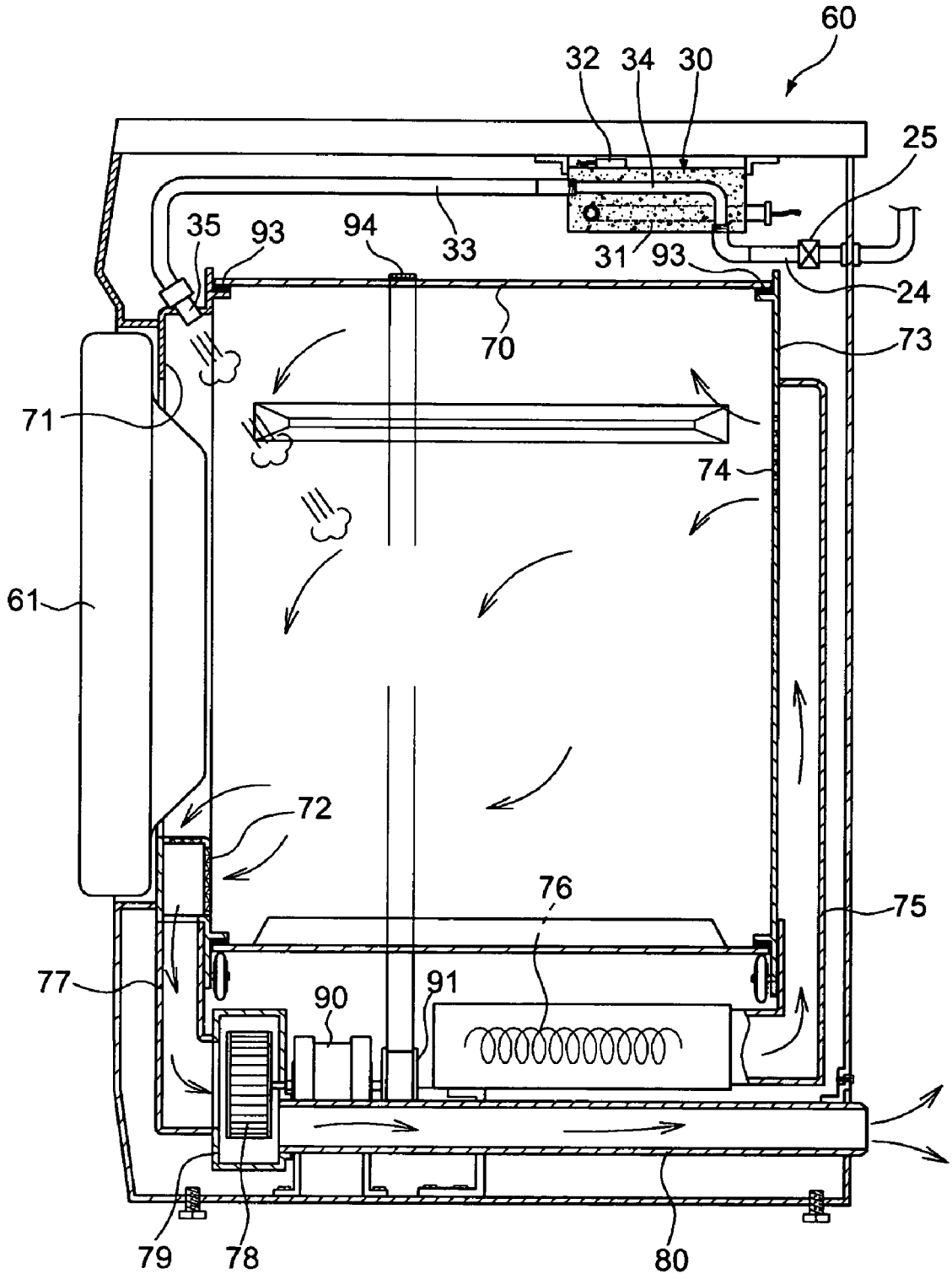
FIG. 2 is a sectional view of a drying machine having a steam generating device in accordance with a second embodiment of the present invention.

FIG. 2 is a sectional view of a drying machine having a steam generating device in accordance with a second embodiment of the present invention.

In FIG. 2, the drying machine having the steam generating device in accordance with the second embodiment of the present invention comprises a drum 70 having a cylindrical structure installed in a housing 60 having an approximately hexahedral structure and provided with opened front and rear surfaces. The drum 70 is supported by a front bracket 71 and a rear bracket 73, which slidably support inner cylindrical surfaces of front and rear ends of the drum 70, and slide pads 93 for facilitating the rotation of the drum 70 are respectively installed between the drum 70 and the front bracket 71 and between the drum 70 and the rear bracket 73.

Air suction holes 74 for sucking hot air therethrough are formed through the upper portion of the rear bracket 73, and an air suction duct 75 for guiding the hot air to the air suction holes 74 is installed in the rear of the rear bracket 73. The air suction duct 75 is extended from the lower part of the drum 70 backwards, and is bent upwards so as to be connected to the air suction holes 74. A heater 76 for heating the air sucked from the inside of the housing 60 is installed at an inlet of the air suction duct 75.

A central portion of the front bracket 71 is opened so that an object to be dried is put into the housing 60 from a door 61 therethrough, and air discharge holes 72 for discharging air containing moisture evaporated from the object are formed through the lower portion of the front bracket 71.

An air discharge duct 77 for discharging the air, discharged from the air discharge holes 72, to the outside of the drying machine, an air blast fan 78, and a discharge pipe 80 are installed below the drum 70. The air discharge duct 77 guides the air, discharged from the air discharge holes 72, to the lower portion of the housing 60. Here, the air discharge duct 77 is connected to the air blast fan 78 generating force for inducing the flow of air in the drying machine.

The air, discharged through the air blast fan 78, is discharged to the outside of the drying machine by a discharge pipe 80, one end of which is connected to a fan casing 79 of the air blast fan 78 and the other end of which is extended to the outside of the housing 60.

A driving motor 90 for simultaneously driving the air blast fan 78 and the drum 70 is installed in the lower portion of the housing 60. A driving shaft is extended outwardly from both ends of the driving motor 90 so that one extended end of the driving shaft is connected to the air blast fan 78 and the other extended end of the driving shaft is connected to a pulley 91 for driving the drum 70. The pulley 91 is connected to the drum 70 by a belt 94, thereby rotating the drum 70 by the driving of the driving motor 90.

In the same manner as the washing machine as shown in FIG. 1, the steam generating device 30 of the drying machine is installed above the drum 70. Since the steam generating device 30 of the drying machine has the same constitution as that of the washing machine of FIG. 1, elements of the steam generating device 30 of the drying machine, which are substantially the same as those of the steam generating device of the washing machine, are denoted by the same reference numerals, and a detailed description thereof will thus be omitted.

Hereinafter, the operation of the above drying machine having the steam generating device will be described.

When the drying machine is operated under the condition that wet clothes are put into the rotary drum 70 through the door 61, the drum 70 and the air blast fan 78 are simultaneously rotated by the operation of the driving motor 90.

The rotation of the drum 70 allows the clothes in the drum 70 to be uniformly mixed and dried, and air in the drum 70 is discharged to the outside by the rotation of the air blast fan 78 through the air discharge duct 77 and the discharge pipe 80.

Here, the air in the housing 60 is supplied to the drum 70 having a low pressure due to the air discharged therefrom, and compensates for the lowered pressure of the drum 70. The air is supplied to the inside of the drum 70 through the air suction duct 75 under the condition that the air is heated by the heater 76 and is converted into hot air. The hot air evaporates moisture contained in the clothes, thereby drying the clothes.

Since control algorithms for eliminating wrinkles in clothes in the washing and drying machines having the steam generating device 30 by generating steam are the same, hereinafter, the control algorithm for eliminating wrinkles in clothes in the washing machine having the steam generating device 30 will be exemplarily described.

Figure 3:
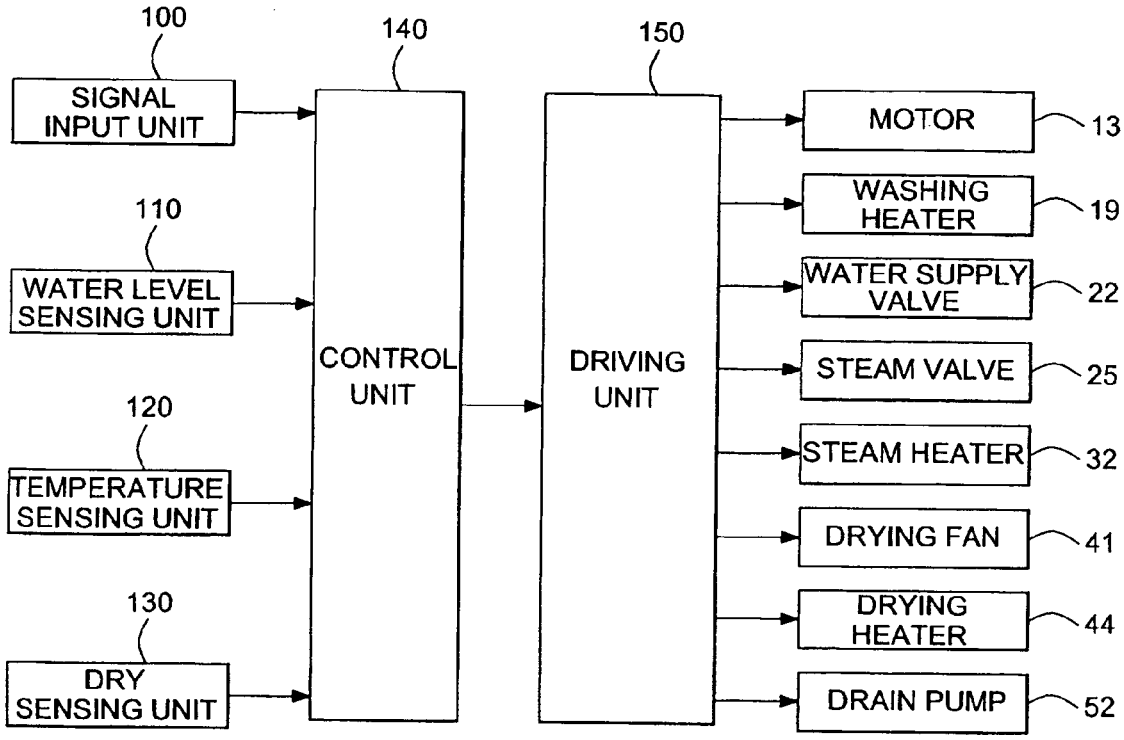
FIG. 3 is a block diagram of a system for controlling the washing machine having the steam generating device in accordance with the present invention.

FIG. 3 is a block diagram of a system for controlling the washing machine having the steam generating device in accordance with the present invention. The system comprises a signal input unit 100, a water level sensing unit 110, a temperature sensing unit 120, a dry sensing unit 130, a control unit 140, and a driving unit 150.

The signal input unit 100 serves to input operating data, such as a washing course, a washing temperature, a dehydration rpm, and whether or not a rinsing operation is added, which are selected by a user according to the materials of the clothes, to the control unit 140. Further, the signal input unit 100 is used to select one of a single wrinkle-eliminating course using steam and a wrinkle-eliminating course after operation.

The water level sensing unit 110 serves to sense the level of the washing water supplied to the tub 11, and the temperature sensing unit 120 serves to sense the temperature of the washing water in the tub 11, the temperature of the steam generating device 30, the internal temperature of the tub 11 (the temperature of the tub 11), and the temperature of hot air supplied to the inside of the tub 11. The dry sensing unit 130 serves to detect the temperature and humidity of the clothes, thereby sensing the dried state of the clothes.

The control unit 140 is a microcomputer for controlling the washing machine according to the operating data inputted from the signal input unit 100, and in the case that the single wrinkle-eliminating course using steam or the wrinkle-eliminating course after operation is selected, controls the driving of the steam generating device 30 and the drying device 40 so that hot air is supplied after steam is supplied for a designated time so as to eliminate the wrinkles in the clothes.

The driving unit 150 drives the motor 13, the washing heater 19, the water supply valve 22, the steam valve 25, the steam heater 32, the drying fan 41, the drying heater 44, and the drainage pump 52 according to a driving control signal of the control unit 140.

Hereinafter, the operation and function of a process for eliminating wrinkles in clothes in the above washing or drying machine having the steam generating device will be described.

Figure 4:
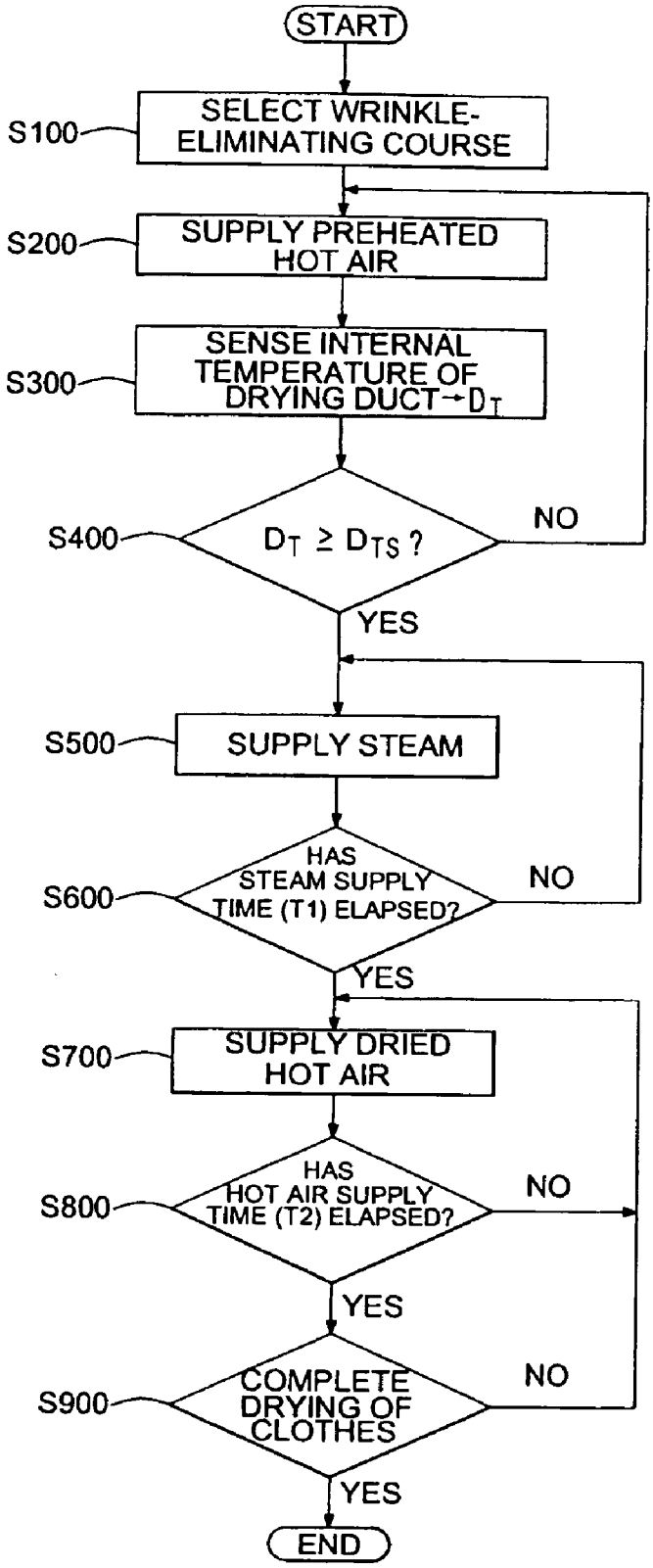
FIG. 4 is a flow chart illustrating a method for eliminating wrinkles in clothes using steam in accordance with the present invention.

FIG. 4 is a flow chart illustrating a method for eliminating wrinkles in clothes using steam in accordance with the present invention. The above method may be performed during the drying operation, or performed independently from the drying operation. Accordingly, a winkle-eliminating operation may be set to a default value so that the wrinkle-eliminating operation is automatically performed when the drying operation is performed, or a separation option key is provided so that the wrinkle-eliminating operation is performed only when a user presses the option key.

When the user puts clothes (laundry), to eliminate wrinkles thereof, into the rotary drum 12 and selects a single wrinkle-eliminating course or the other option (a wrinkle-eliminating course after operation), the operating data selected by the user are inputted to the control unit 140 through the signal input unit 100 (S100).

Here, the clothes in the rotary drum 12 may be clothes, which require only the elimination of wrinkles generated when the clothes are put on or stored, or clothes, which had been washed.

When the wrinkle-eliminating course is selected, the control unit 140 controls the drying device 40 so that hot air at a predetermined temperature (temperature for smoothly spraying steam: approximately 40~60) is supplied to the rotary drum 12 (S200).

Hereinafter, the above preheated hot air supply step will be described in more detail.

The rotary drum 12 is slowly rotated at a predetermined rpm and a predetermined operation ratio by the operation of the motor 13. When the drying fan 41 is operated under the above state, the air in the tub 11 is sucked into the drying fan 41 through the condensing duct 43, and is then discharged to the inside of the tub 11 through the drying duct 42. This circulation of the air is repeated.

Here, the air in the drying duct 42 is heated by the drying heater 44 and is introduced into the rotary drum 12, thereby heating the air and the clothes in the rotary drum 12.

Since the internal temperature of the rotary drum 12 is increased by supplying the hot air to the rotary drum 12 before steam is sprayed onto the clothes in the rotary drum 12, it is possible to prevent the glass door 15 from being frozen and cracking in winter, to smoothly spray steam due to the increase of the temperatures of the drying duct 42 and the door 15, and to separate dust or contaminants from the clothes by supplying hot air to the clothes.

In the preheated hot air supply step, the predetermined rpm and operation ratio of the rotary drum 12 are values, which are set by a designer using experimental data, and vary according to volumes or design conditions of a product. If necessary, the rotary drum 12 is not rotated.

In the preheated hot air supply step, since the internal temperature of the rotary drum 12 is increased by the hot air supplied to the inside of the rotary drum 12 through the drying duct 42, the internal temperature ($D_T$) of the drying duct 42 is sensed by the temperature sensing unit 120 and is outputted to the control unit 140 (S300).

The control unit 140 compares the internal temperature ($D_T$) of the drying duct 42, inputted from the temperature sensing unit 120, to a predetermined temperature ($D_{TS}$: a temperature for smoothly spraying steam, approximately 40~60° C.), and determines whether or not the internal temperature ($D_T$) is more than the predetermined temperature ($D_{TS}$) (S400).

When the internal temperature ($D_T$) is more than or equal to the predetermined temperature ($D_{TS}$), the control unit 140 determines that the internal temperature of the rotary drum 12 is increased enough to smoothly spray the steam, and stops the supply of the preheated hot air.

After the supply of the preheated hot air is completed, the control unit 140 controls the steam generating device 30 so that steam is supplied to the inside of the rotary drum 12 for a predetermined time (S500).

Hereinafter, the above steam supply step will be described in more detail.

The rotary drum 12 is slowly rotated at a predetermined rpm and a predetermined operation ratio (on/off ratio, for example a ratio of 20 seconds/2 seconds) by the operation of the motor 13). In this state, the steam valve 25 is opened, and water is supplied to the steam generating device 30 through the steam water supply pipe 24. The water, supplied to the steam generating device 30, is momentarily heated by the steam heater 31, and generates steam of a high temperature of more than 100° C. The steam of the high temperature is supplied to the inside of the tub 11 through the steam generating pipe 33 and the drying duct 42, thereby being sprayed directly onto the clothes in the tub 11.

As described above, in the method for eliminating wrinkles in clothes of the present invention, the steam, which is directly sprayed onto the clothes in the tub 11, affects a rearrangement of bridge bonds in fiber to eliminate the wrinkles in the clothes, and has a sterilizing effect of the clothes.

In the steam supply step, the predetermined rpm and operation ratio of the rotary drum 12 are values, which are set by the designer using experimental data, and vary according to volumes or design conditions of a product. Generally, the predetermined rpm and operation ratio of the rotary drum 12 in the steam supply step are higher than those of the rotary drum 12 in the preheated hot air supply step.

Thereafter, the control unit 140 checks the steam supply time of the steam generating device 30, and determines whether or not a designated time (T1: the overall operation time of the steam generating device 30 from the preheating of the heater) has elapsed (S600). When the designated time (T1) has elapsed, the control unit 140 stops the operation of the steam generating device 30.

After the supply of the steam is completed, the control unit 140 controls the drying device 40 so that dried hot air of a predetermined temperature (temperature lower than that of a general drying operation; approximately 70° C.) is supplied to the inside of the rotary drum 12 for a predetermined time (S700).

Hereinafter, the above dried hot air supply step will be described in more detail.

The rotary drum 12 is slowly rotated at a predetermined rpm and a predetermined operation ratio by the operation of the motor 13 so that the clothes are dropped in the rotary drum 12. When the drying fan 41 is operated under the above state, the air in the tub 11 is sucked into the drying fan 41 through the condensing duct 43, and is then discharged to the inside of the tub 11 through the drying duct 42. This circulation of the air is repeated.

Here, the air in the drying duct 42 is heated by the drying heater 44, and is introduced into the rotary drum 12, thereby heating and drying the clothes in the rotary drum 12.

As described above, in the method for eliminating wrinkles in clothes of the present invention, the hot air, which is supplied to the clothes after the steam is sprayed onto the clothes, efficiently eliminates wrinkles in the clothes without ironing, and the clothes do not require an additional drying step, thus being simply treated.

In the dried hot air supply step, the predetermined rpm and operation ratio of the rotary drum 12 vary according to volumes or design conditions of a product. Generally, the predetermined rpm and operation ratio of the rotary drum 12 in the dried hot air supply step are higher than those of the rotary drum 12 in the steam supply step.

Thereafter, the control unit 140 checks the hot air supply time of the drying device 40, and determines whether or not a designated time (T2: approximately 15 minutes) has elapsed (S800). When the designated time (T2) has elapsed, the control unit 140 senses the temperature and humidity of the clothes by the drying sensor 47, and determines whether or not the drying of the clothes is completed (S900).

When the drying of the clothes is not completed, the control unit 140 feeds the method back to the step S700 so that the dried hot air is continuously supplied, and when the drying of the clothes is completed, the control unit 140 stops the operation of the drying device 40.

Although the exemplary embodiment of the present invention, the determination whether or not the drying of the clothes is completed according to the temperature and humidity of the clothes is performed after the hot air supply time has elapsed, the determination may be performed before the hot air supply time has elapsed, and thus it is possible to stop the supply of the hot air before the designated time has elapsed.

Figure 5:
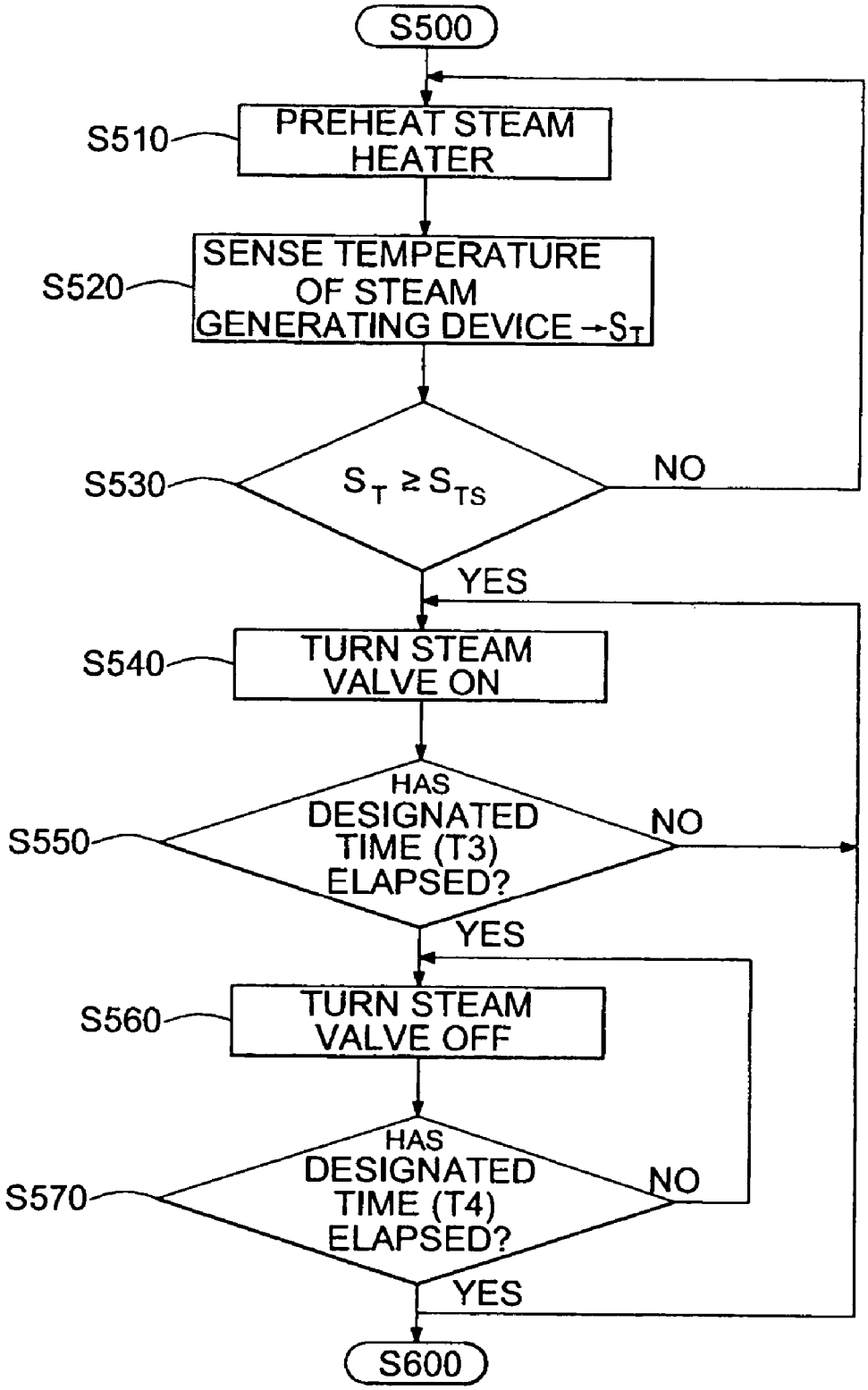
FIG. 5 is a flow chart illustrating a steam-supplying step of FIG. 4 in detail.

Now, with reference to FIG. 5, the steam supply step of the method for wrinkles in clothes using the steam shown in FIG. 4 will be described in more detail.

In order to supply a large quantity of steam of a high temperature of more than 100° C. to the inside of the tub 11, the control unit 140 preheats the steam heater 31 installed in the steam generating device 30 (S510).

The preheating of the steam heater 31 allows the steam generating device 30 in an initial operating stage to supply pure steam, which is not mixed with water of a normal temperature (23~24° C.), to the inside of the tub 11.

The temperature ($S_T$) of the steam generating device 30 heated by the preheating of the steam heater 31 is sensed by the temperature sensing unit 120, and is outputted to the control unit 140 (S520). The control unit 140 compares the temperature ($S_T$) of the steam generating device 30, inputted from the temperature sensing unit 120, to a predetermined reference temperature ($S_{TS}$: the lowest temperature at which the steam heater is heated for generating the steam, approximately 100° C.), and determines whether or not the temperature ($S_T$) of the steam generating device 30 is more than the predetermined reference temperature ($S_{TS}$) (S530).

As a comparison result, when the temperature ($S_T$) of the steam generating device 30 is more than or equal to the predetermined reference temperature ($S_{TS}$), the control unit 140 turns the steam valve 25 on (S540).

When the steam valve 25 is turned on, water is supplied to the steam generating device 30 through the steam water supply pipe 24, and the water, supplied to the steam generating device 30, is momentarily heated by the steam heater 32, thus generating steam of a high temperature of more than 100° C.

The steam of the high temperature is supplied to the inside of the tub 11 through the steam supply pipe 33 and the spray nozzle 35, thus being sprayed onto clothes, to eliminate wrinkles thereof.

Thereafter, when a predetermined time (T3: time for generating pure steam of a high temperature of more than 100° C., approximately 2 seconds) from the turning on of the steam valve 25 has elapsed (S550), the control unit 140 turns the steam valve 25 off (S560).

When a predetermined time (T4: time for increasing the temperature of the steam generating device to a high temperature of more than 100° C., approximately 10 seconds) from the turning off of the steam valve 25 has elapsed (S570), the control unit 140 turns the steam valve 25 on again. Then, the above procedure is repeated.

Although the exemplary embodiment discloses a drum washing machine having a drying function, the present invention is not limited thereto. That is, the present invention may be applied to any washing or drying machine, which can supply steam and hot air.

As apparent from the above description, the present invention provides an apparatus and method for eliminating wrinkles in clothes in a washing or drying machine having a steam generating device, in which wrinkles in clothes, in a state in which the clothes are worn by a user or stored as well as in a state in which washing of the clothes is terminated by a single wrinkle-eliminating course or a wrinkle-eliminating course after operation, are eliminated.

In the apparatus and method for eliminating wrinkles in clothes, steam at a high temperature is sprayed directly to less contaminated clothes necessary to be smoothed down rather than to be washed, thereby effectively eliminating the wrinkles in the clothes without washing, and sterilizing the clothes.

In the apparatus and method for eliminating wrinkles in clothes, since hot air is supplied to the clothes, to which steam was sprayed, it is possible to efficiently eliminate the wrinkles in the clothes without ironing and to omit any additional drying operation, thereby shortening a drying time and easily treating the clothes.

In the apparatus and method for eliminating wrinkles in clothes, hot air is supplied to the clothes prior to the steam being sprayed to the clothes, thereby eliminating dust or contaminants from the clothes, preventing a door from being frozen and cracking in the winter due to the sprayed steam, and inducing the steam to be smoothly sprayed.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A method for eliminating wrinkles in clothes comprising:

determining whether or not a wrinkle-eliminating course is selected;

supplying steam to the clothes in response to it being determined that the wrinkle-eliminating course is selected in the determining; and supplying hot air to the clothes, to which the steam was previously supplied in the supply steam, to eliminate the wrinkles in the clothes.

2. The method as set forth in claim 1, wherein the wrinkle-eliminating course is an independent course for only eliminating the wrinkles in the clothes.

3. The method as set forth in claim 1, wherein the steam is supplied for a predetermined time.

4. The method as set forth in claim 1, wherein the hot air is supplied for a predetermined time, or according to the dried state of the clothes.

5. The method as set forth in claim 1, wherein hot air obtained by pre-heating is supplied to the clothes before the steam is supplied to the clothes so as to eliminate dust from the clothes.

6. A method for eliminating wrinkles in clothes comprising:

determining whether or not a wrinkle-eliminating course is selected;

supplying first hot air to the clothes to eliminate dust from the clothes in response to it being determined that the wrinkle-eliminating course is selected in the determining; and supplying steam to the clothes, from which the dust was previously eliminated in the supplying first hot air, to eliminate the wrinkles in the clothes.

7. The method as set forth in claim 6, wherein second hot air is supplied to the clothes, to which the steam was supplied, to eliminate the wrinkles in the clothes.

8. An apparatus for eliminating wrinkles in clothes contained in a drum, comprising:

a signal input unit for selecting a wrinkle-eliminating course;

a steam generating device for supplying steam to an inside of the drum; and a single control unit for controlling both the steam generating device and a drying device to eliminate the wrinkles in the clothes in response to the wrinkle-eliminating course being selected.

9. The apparatus as set forth in claim 8, wherein the wrinkle-eliminating course is an independent course for only eliminating the wrinkles in the clothes or an operational course for eliminating the wrinkles in the clothes after an operation is completed.

10. The apparatus as set forth in claim 8, wherein the control unit operates the steam generating device for a predetermined time to control the supplying of the steam.

11. The apparatus as set forth in claim 8, wherein the drum is rotated at a predetermined rpm and a predetermined operation ratio when the steam and the hot air are supplied to the inside of the drum.

12. The apparatus as set forth in claim 8, wherein the control unit controls the supplying of the hot air by operating the drying device for a predetermined time or according to a dried state of the clothes.

13. An apparatus for eliminating wrinkles of clothes, contained in a drum, comprising:

a steam generating device for spraying steam to the inside of a drum;

a drying device for supplying hot air to the inside of the drum; and a control unit for controlling both the steam generating device and the drying device, wherein, when instructions for spraying the steam to the inside of the drum are inputted to the control unit by a user, the control unit operates the drying device to supply the hot air in advance.

14. The apparatus as set forth in claim 13, wherein the instructions for spraying the steam to the inside of the drum are given in a steam washing operation.

15. The apparatus as set forth in claim 13, wherein the instructions for spraying the steam to the inside of the drum are given in a wrinkle eliminating operation.

16. The method as set forth in claim 1, wherein the determining determines whether or not the wrinkle-eliminating course is selected from a plurality of courses.

17. The method as set forth in claim 6, wherein the steam is supplied to the clothes to eliminate wrinkles in the clothes if the first hot air raises a temperature to a predetermined temperature.

18. The method as set forth in claim 17, wherein the predetermined temperature is within a range of 40° C.-60° C.

19. The method as set forth in claim 7, wherein the second hot air is supplied at an approximate temperature of 70° C.

* * * * *